United States Patent [19]

Payne

[11] 4,340,926

[45] Jul. 20, 1982

[54] DEVICE FOR ELECTROSTATICALLY CHARGING SHEET MATERIAL

[76] Inventor: John M. Payne, 36a High St., Maxey, Peterborough, England

[21] Appl. No.: 198,950

[22] PCT Filed: Nov. 21, 1979

[86] PCT No.: PCT/GB79/00198

§ 371 Date: Jul. 16, 1980

§ 102(e) Date: Jul. 16, 1980

[87] PCT Pub. No.: WO80/01112

PCT Pub. Date: May 29, 1980

[30] Foreign Application Priority Data

Nov. 23, 1978 [GB] United Kingdom ..... 45805/78

[51] Int. Cl.[3] ..... H01T 19/00

[52] U.S. Cl. ..... 361/229; 361/230

[58] Field of Search ..... 361/212, 213, 214, 220, 361/221, 225, 229, 230

[56] References Cited

U.S. PATENT DOCUMENTS 2,000,684 5/1935 Allen et al. ..... 361/225 X

FOREIGN PATENT DOCUMENTS 2044828 4/1972 Fed. Rep. of Germany ..... 361/220

OTHER PUBLICATIONS

"Corona Flat Cable Treatment"—Davies et al; IBM Technical Disclosure Bulletin, vol. 18, No. 7, 12/75.

*Primary Examiner*—Harry E. Moose, Jr.

*Attorney, Agent, or Firm*—Oblon, Fisher, Spivak, McClelland & Maier

[57] ABSTRACT

A charging device for charging paper and other flexible material comprising a cylindrical cavity (16) in a housing (10) having an inlet and an outlet (typically a single slit) (12)) into which and from which the flexible medium (14) can pass. Centrally along the axis of the cavity is a charging conductor (28) and the conductive interior of the cavity (20) and the conductor (28) are connected to opposite sides of a source of potential (38). A perforated cylindrical guide (30) may be located within the cavity so as to define a narrow annular gap around which the flexible medium can pass. Three rollers (32,34,36) forming entrance and exit nips for the flexible medium (14) may be located at the entrance/exit slit.

11 Claims, 4 Drawing Figures

DEVICE FOR ELECTROSTATICALLY CHARGING SHEET MATERIAL

FIELD OF INVENTION

This invention concerns a device for electrostatic charging of sheet material eg paper typically for use in photocopiers and the like.

BACKGROUND TO THE INVENTION

Many photocopying processes involve the electrostatic charging of a sheet or roll of paper and the subsequent exposure of the charged surface to a light image of the document which is to be copied. The application of the electrostatic charge to the paper should be as uniform as possible to avoid differences in sensitivity over the surface of the paper.

Hitherto a charging device has typically comprised one or more lengths of wire which are stretched between insulating supports and are charged to a high potential from a high tension source and adjacent to which the paper is moved. Although a non-uniform pattern of charge would result from a static exposure of a sheet of paper to the charging device a relatively uniform charge can be produced over the surface of the paper by moving the paper relative to the charging device.

In addition a sufficient level of charge is obtained by using a charging device at a very much higher potential than in theory is necessary so as to ensure that the whole surface of the paper receives a charge which exceeds a minimum potential.

Known devices therefore require very high potential sources and appropriate traction means for moving the paper uniformly past the charging device and are not particularly suited to photocopying systems in which the power supply requirements are limited and/or in which the speed of movement of the paper past the charging device is not necessarily well controlled or uniform and in which the source of high tension does not necessarily produce a continuous charge but produces a series of pulses as in the case of a power supply incorporating a piezo-electric crystal which is squeezed so as to produce a high voltage across the crystal which can then be dissipated through the charging device onto the paper.

OBJECTS OF THE PRESENT INVENTION

With this in mind the present invention has as its object the production of a charging device which can be used to charge a paper more uniformly and more readily than hitherto particularly when using a non-uniform traction of paper past the charging device and/or a lower power and/or pulsed operation charge source.

THE INVENTION

According to the present invention a device for charging paper and like flexible material comprises a housing containing a cylindrical cavity at least the curved surface of which is conductive, an inlet and an outlet to allow the flexible medium to be introduced into and extend around the internal curved surface of the cylindrical cavity and to leave via the outlet, and an elongate conductor extending coaxially through the cavity and electrically insulated from said conductive surface and a source of electric potential with one terminal connected to the conductive surface and the other to the elongate conductor.

The housing may be of insulating material and the conductive surface may be a film or coating or sheet of conductive material such as metal.

Alternatively the housing may be of conductive material and may be mounted in an insulating manner with the elongate conductor stretched between insulating mountings at opposite ends of the housing.

The inlet and outlet may be separate slits in the housing or may be combined into a single slit into which the flexible medium is fed and from which the flexible medium leaves the housing.

The ends of the cavity may be adapted to receive and grip the incoming paper and may be rotatable relative to the remainder of the housing so as to provide a traction drive for the flexible material around the interior of the cavity.

A cylindrical guide may be located within the housing, the diameter of the guide being just less than the internal diameter of the housing, so as to leave a narrow gap around which the flexible medium will pass. The guide is preferably perforated or otherwise apertured to permit the passage of electric charge from the conductor to the medium.

It has been found that the presence of the perforated guide enhances the charge delivered to the paper.

Preferably the perforated guide revolves within the housing.

The flexible medium may be a length of paper pulled from a roll of paper or individual sheets of paper or any other flexible medium. Whatever the material it may be untreated or chemically treated as with a photo-sensitive material such as zinc oxide to form a photoreceptive surface.

The invention allows more even distribution of charge to be obtained over the flexible material than has hitherto been the case. Particularly this is the case when the source of charge is the type which produces a burst of potential which then decays over a period of time until the next burst is produced as for example an H.T. source incorporating a piezo-electric crystal which is squeezed periodically to obtain high voltage bursts between its faces.

The invention will now be described by way of example with reference to the accompanying drawings.

IN THE DRAWINGS

DETAILED DESCRIPTION OF DRAWINGS

Figure 1:
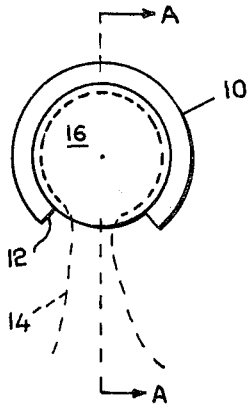
FIG. 1 is an end view of a charging unit embodying the invention.

As shown in the drawings, a charging unit embodying the invention comprises a generally cylindrical housing 10 having a single aperture 12 through which a sheet of paper shown in dotted outline at 14 can be fed and out of which the other end of the paper can exit after having traversed the interior of the cylindrical housing which forms a cylindrical cavity generally designated 16.

Figure 2:
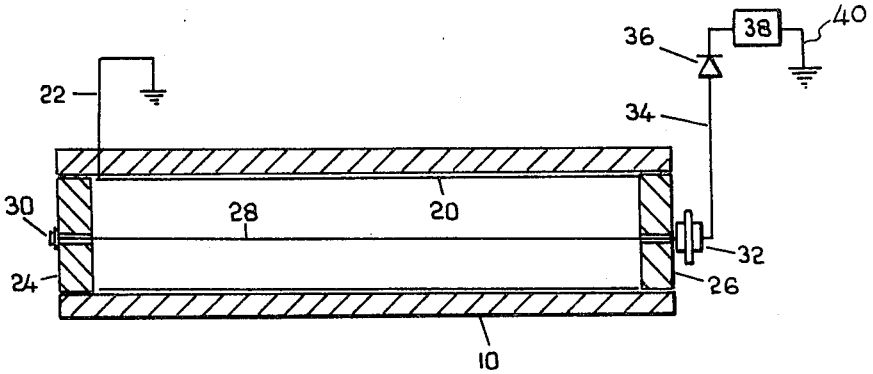
FIG. 2 is a cross-section through the unit of FIG. 1 on the line A—A.

The inside surface of the cavity 16 is coated with a conductive material as denoted by reference numeral 20 in FIG. 2 and for convenience the conductive coating 20 is connected via a conductor 22 to earth (or to one terminal of a high tension source).

In the embodiment shown in the drawings the housing is formed from insulating material and two circular end caps 24 and 26 are fitted into the opposite ends of the generally cylindrical tube 10 to form the cavity and each of the end caps 24 and 26 is apertured to receive a wire electrode 28 which is stretched therebetween. A stop 30 at one end of the wire prevents the wire from pulling through the end cap 24 and a tensioning device 32 is located at the other end of the wire 28 so that the latter can be stretched between the two end caps 24 and 26 and the tension adjusted to suit.

A conductor 34 (which may be an extension of the wire 28) connects the latter via a rectifying device 36 such as a diode to one terminal of the output of a high tension source 38 the other terminal of which is connected via a conductor 40 to earth.

Although not shown in detail the source of potential 38 comprises a piezo-electric crystal with means for squeezing same to produce a high voltage potential across its faces which in turn is conveyed to the two terminals of the source.

As is well known when the squeezing action is released, a potential of equal and opposite polarity is produced across the faces of the crystal and it is for this reason that the diode rectifying device 36 is incorporated so as to prevent charge of one polarity from reaching the electrode wire 28.

The conductive interior of the cavity formed by the lining 20 may be formed by spray painting with a metallic suspension paint onto the interior surface of the electrical insulating tubular member 10 or by securing a sheet of electrically conductive foil such as aluminium foil onto the interior surface of the cavity by means of an adhesive or the like.

The aperture 12 allows the paper or other flexible medium 14 to be fed into and around the interior of the cavity and to exit therefrom. Alternatively two apertures may be provided suitably angled so as to introduce the paper substantially tangentially to the surface of the interior of the cavity and to allow same to leave and the one aperture serves as an inlet and the other as an outlet.

The circular extent of the aperture into and from which the flexible material enters and leaves the cavity is as small as possible compatible with the requirement that the flexible material will leave the cavity as shown in FIG. 1. By ensuring that the circular extent of the aperture is as small as possible so the maximum area of the paper is presented to the electrode wire 28 and by moving the paper around the interior of the cavity so different points on the circumference of the wire electrode 28 are presented to the paper so that on the assumption that the charge distribution around the wire is not necessarily uniform, nevertheless the net effect of presenting the paper to the wire electrode in this way is to cause an integration of the charge over the area of the paper presented thereto over the time period during which it is presented thereto which tends to produce a uniform charge over the area of the flexible material.

Where the flexible material is a coated paper such as zinc oxide coated paper, it is inserted into the aperture 12 so that the coated surface faces the wire electrode 28.

It has been found by experiment that the voltage required to produce an acceptable level of charge on zinc oxide coated paper to permit photocopying thereon is considerably reduced if a corona charging unit of the type described and shown in FIGS. 1 and 2 hereof is employed in place of a conventional charging unit.

It is important that the flexible material adheres to the inside surface of the cavity and therefore the feed into the cavity should preferably be at a slightly greater rate than the withdrawal traction from the cavity so that the paper is at all times pressed into the curved surface within the cavity. Alternatively, although not shown, the two end caps 24 and 26 may be adapted to grip the edges of the flexible material within the cavity and drive means may be provided for rotating the end caps so as to draw the flexible medium into and around the interior of the cavity.

Where this latter feature is incorporated, independent driving wheels (not shown) are preferably provided on the same axis as the wire electrode 28 so that it is not necessary for the wire to rotate but the latter can remain stationary relative to the cavity.

Figure 3:
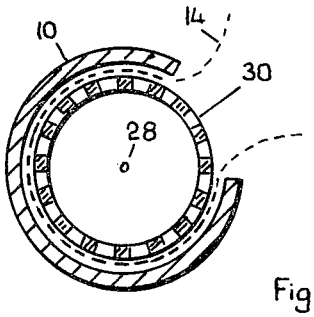
FIG. 3 is an end view in cross-section of another embodiment.

FIG. 3 shows how a perforated drum 30 may be situated within the housing 10 to provide an annular guide for a sheet of paper 14. The drum 30 is mounted for rotation within the housing 10.

Figure 4:
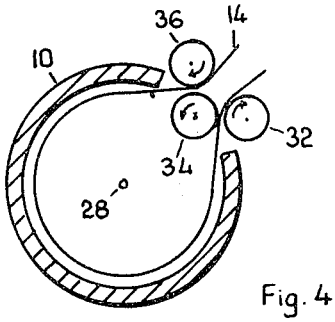
FIG. 4 is an end view also in cross-section of a further embodiment of the invention.

FIG. 4 illustrates a preferred drive for feeding paper into and extracting paper from a charging unit embodying the invention. To this end three driven rollers 32, 34 and 36 are provided at the entrance/exit and are rotated in the directions shown by the arrows. Paper 14 entering the nip between rollers 34, 36 will be caused to pass around the interior of the housing 10 and will be pulled out through the nip between rollers 32, 34.

The feed shown in FIG. 4 may be used in conjunction with a charging device such as shown in FIGS. 1 and 2 or with a device such as shown in FIG. 3.

It is to be understood that the circular extent of the wall of the housing 10 need not be of the order of 300° (i.e. almost full circle) as shown in the drawings, but may be of much smaller circular extent i.e. so as to subtend for example 180° or thereabouts.

I claim:

1. In a photographic copier, a device for charging paper by corona discharge, comprising:

a cylindrical housing defining a cylindrical cavity and having a conductive internal surface;

an inlet and an outlet to allow the paper to be introduced and extend around said internal surface;

a wire conductor extending along the axis of the cylindrical housing and insulated from the conductive internal surface thereof; and a source of electric potential with one terminal connected to the conductive surface and the other to the wire conductor in order to produce a corona discharge therebetween for laying a static charge on the paper.

2. A device as claimed in claim 1 in which the housing comprises:

an insulating material provided with a layer of conductive material on the interior thereof to form said conductive internal surface.

3. A device as claimed in claim 1 in which the housing comprises:

a conductive material; and insulating mountings at opposite ends of the housing between which the wire conductor is stretched.

4. A device as claimed in claim 1 in which the inlet and outlet are combined into a single slit into which the paper is fed and from which the paper leaves the housing.

5. A device as claimed in claim 1 in which the housing comprises:

end members adapted to receive and grip the incoming paper and which are rotatable relative to the housing interior so as to provide a traction drive for the paper around the interior of the cavity.

6. A device as claimed in claim 1 further comprising:

a cylindrical guide located within the cavity, the diameter of the guide being just less than the internal diameter of the housing so as to leave a narrow gap around which the paper will pass.

7. A device as claimed in claim 6 in which the guide is apertured to permit the passage of corona discharge from the wire conductor to the paper.

8. A device as claimed in claim 6 in which the guide is rotatable within the housing.

9. A device as claimed in claim 1 wherein the source of electric potential comprises:

a piezo-electric crystal; and means for stressing or relieving the stress within the crystal so as to prodcue a high voltage thereacross.

10. A device as claimed in claim 9 further comprising:

a rectifying means to ensure that charge of one polarity only is applied to the wire charging conductor.

11. A device as claimed in claim 1 further comprising:

three driven rollers adjacent the inlet and outlet; and, means for driving the rollers so a to form two nips one of which will cause the paper to be drawn into the inlet and the other of which will cause the paper leaving the outlet to be drawn away therefrom, one of the three said rollers being common to the two said nips.

* * * * *